US010727008B2

(12) United States Patent
Hoffmann et al.

(10) Patent No.: US 10,727,008 B2
(45) Date of Patent: Jul. 28, 2020

(54) CONTACT DEVICE FOR AN ELECTRICAL SWITCH, AND ELECTRICAL SWITCH

(71) Applicant: EPCOS AG, München (DE)

(72) Inventors: Robert Hoffmann, Berlin (DE); Thomas Westebbe, Berlin (DE)

(73) Assignee: EPCOS AG, Munich (DE)

( * ) Notice: Subject to any disclaimer, the term of this patent is extended or adjusted under 35 U.S.C. 154(b) by 206 days.

(21) Appl. No.: 15/754,993

(22) PCT Filed: Jul. 18, 2016

(86) PCT No.: PCT/EP2016/067031
§ 371 (c)(1),
(2) Date: Feb. 23, 2018

(87) PCT Pub. No.: WO2017/032508
PCT Pub. Date: Mar. 2, 2017

(65) Prior Publication Data

US 2019/0206633 A1 Jul. 4, 2019

(30) Foreign Application Priority Data

Aug. 25, 2015 (DE) ..... 10 2015 114 083

(51) Int. Cl.
*H01H 9/30* (2006.01)
*H01H 1/20* (2006.01)
(Continued)

(52) U.S. Cl.
CPC ..... *H01H 1/20* (2013.01); *H01H 9/443* (2013.01); *H01H 33/182* (2013.01); *H01H 50/546* (2013.01)

(58) Field of Classification Search
CPC ..... H01H 1/20; H01H 9/16; H01H 9/443; H01H 50/546; H01H 33/82
(Continued)

(56) References Cited

U.S. PATENT DOCUMENTS 8,410,878 B1 4/2013 Takaya et al.
8,653,691 B2 2/2014 Hsu et al.
(Continued)

FOREIGN PATENT DOCUMENTS

DE 102009047080 A1 6/2011
DE 102012000272 A1 7/2012
(Continued)

*Primary Examiner* — Shawki S Ismail
*Assistant Examiner* — Lisa N Homza

(57) ABSTRACT

A contact device for an electrical switch, and an electrical switch are disclosed. In an embodiment the contact device includes a first connection element, a second connection element, a movable contact bridge, at least two magnets configured to quench arcs which arise during a switching of the electrical switch, wherein the magnets are configured to generate a magnetic field in a first region which comprises at least one first contact region and one second contact region, in which, when the electrical switch is in a closed switching position, the first connection element and the second connection element are in contact with the contact bridge and at least one deflection element configured to distort the magnetic field such that a first arc when formed between the first connection element and the contact bridge, and a second arc when formed between the second connection element and the contact bridge, are forced into different directions, pointing away from each other.

12 Claims, 3 Drawing Sheets

(51) Int. Cl.
*H01H 9/44* (2006.01)
*H01H 33/18* (2006.01)
*H01H 50/54* (2006.01)

(58) Field of Classification Search
USPC ..... 335/201
See application file for complete search history.

(56) References Cited

U.S. PATENT DOCUMENTS

| | | | | |
|---|---|---|---|---|
| 8,853,585 | B2 | 10/2014 | Tachikawa et al. | |
| 2011/0120844 | A1* | 5/2011 | Hoffmann | H01H 50/02 200/275 |
| 2012/0181953 | A1* | 7/2012 | Hsu | H01H 9/443 318/139 |
| 2016/0071670 | A1* | 3/2016 | Haehnel | H01H 50/546 218/24 |

FOREIGN PATENT DOCUMENTS

| | | | |
|---|---|---|---|
| DE | 102012000313 | A1 | 7/2012 |
| DE | 102013210195 | A1 | 12/2014 |
| DE | 102014100720 | A1 | 7/2015 |
| EP | 1168392 | A1 | 1/2002 |
| EP | 2019405 | A1 | 1/2009 |
| EP | 2557583 | A1 | 2/2013 |
| EP | 2608235 | A2 | 6/2013 |
| EP | 2637190 | A1 | 9/2013 |
| GB | 622381 | A | 5/1949 |
| JP | 2010188711 | A | 9/2010 |
| JP | 2011204478 | A | 10/2011 |
| JP | 2012160427 | A | 8/2012 |

* cited by examiner

CONTACT DEVICE FOR AN ELECTRICAL SWITCH, AND ELECTRICAL SWITCH

This patent application is a national phase filing under section 371 of PCT/EP2016/067031, filed Jul. 18, 2016, which claims the priority of German patent application 10 2015 114 083.7, filed Aug. 25, 2015, each of which is incorporated herein by reference in its entirety.

TECHNICAL FIELD

The invention relates to a contact device for an electrical switch. Furthermore, the invention relates to an electrical switch which comprises the contact device.

BACKGROUND

Relays and, in particular, contactors are used mainly for switching high and maximum electrical loads. Such switches preferably comprise contact cavities, for which high requirements are placed with respect to possible operating temperatures, permitted internal pressures, the electrical insulating capacity, and the are load stability. Switching arcs occur in a relay when the current is interrupted. These switching arcs must be interrupted, in order to safely interrupt the current flow and counteract a destruction of the component.

Magnetic blowouts are frequently utilized for quenching the arcs. A magnetic blowout is a permanent magnet or an electromagnet which is used for deflecting the switching are between the contacts of the relay by means of the Lorentz force acting on the arcs and, as a result, lengthening the switching arcs and, therefore, more rapidly quenching the arcs.

SUMMARY OF THE INVENTION

Embodiments provide a contact device for an electrical switch and an electrical switch, which allows for a more reliable operation of the electrical switch. Embodiments further provide an electrical switch with a lower failure probability, so that at least a partial destruction is reduced.

The invention is distinguished, according to a first aspect of the invention, by a contact device for an electrical switch. The contact device comprises a first connection element, a second connection element, and a movable contact bridge. Furthermore, the contact device comprises at least two magnets for quenching arcs which arise during the switching of the electrical switch. The magnets generate a magnetic field in a first region which comprises at least one first contact region and one second contact region, in which contact regions, with the electrical switch in a closed switching position, the first connection element and the second connection element are in contact with the contact bridge. Moreover, the contact device comprises one or more deflection elements which are situated and designed for distorting the magnetic field in such a way that a first are, which forms between the first connection element and the contact bridge, and a second are, which forms between the second connection element and the contact bridge, are forced into different directions, which extend pointing away from each other, independently of a particular current direction in the connection elements.

This has the advantage that a connection of the two arcs, in particular in a gas-filled space of the contact device, can be prevented and, specifically, regardless of the direction in which the current flows in the contact device. A direct arcing short circuit in the electrical switch can be prevented. By utilizing the Lorentz forces, the arcs are lengthened and they are quenched more rapidly, since they have a larger surface area and, therefore, cool down more rapidly, and the arcs, which include ionized air, lose their conductivity more rapidly. The contact device can be advantageously utilized for electrical switches which are used in conjunction with a charging and discharging of an electrical energy accumulator, since different current directions occur in this case.

The contact bridge can assume a first position, in which the contact bridge conductively connects the first connection element and the second connection element. Furthermore, the contact bridge can assume a second position, in which the first connection element and the second connection element are insulated.

In one advantageous embodiment according to the first aspect, a first directional vector, which represents the direction into which the first are is forced, encloses an angle with a connection axis, which connects a center of the first contact region to a center of the second contact region, within the range of greater than 90° to less than 270°. A second directional vector, which represents the direction into which the second are is forced, encloses an angle with the connection axis within the range of less than 90° to greater than −90°. The first directional vector comprises a directional component along the connection axis, which points away from the second contact region. The second directional vector comprises a directional component along the connection axis, which points away from the first contact region. In this way, it can be ensured that a connection of the two arcs does not take place.

In yet another advantageous embodiment according to the first aspect, the at least one deflection element is situated partially around a region in which the first connection element and the second connection element and the contact bridge are situated. Preferably, the contact device comprises at least two deflection elements which are situated partially around the region. Preferably, the region in which the first connection element and the second connection element and the contact bridge are situated, and around which the at least one deflection element is situated, is rectangular or approximately rectangular. This advantageously allows for a low-cost production of the contact device.

In yet another advantageous embodiment according to the first aspect, at least one of the magnets is situated on a first side of the region in which the first connection element and the second connection element and the contact bridge are situated. Furthermore, at least one of the magnets is situated on a second side of the region, which is opposite the first side. The contact device comprises a first deflection element which has a first bracket having a first bracket section and a second bracket section, wherein the first bracket section extends at least partially along a first end face of the region and the second bracket section extends at least partially along the first side of the region. Moreover, the contact device comprises a second deflection element which has a second bracket having a first bracket section and a second bracket section, wherein the first bracket section extends at least partially along a second end face of the region, which is opposite the first end face, and the second bracket section extends partially along the second side of the region. The brackets advantageously cause the magnetic field to be distorted, independently of a particular current direction in the first and the second connection elements, in such a way that the first are, which forms between the first connection element and the contact bridge, and the second are, which forms between the second connection element and the contact bridge, are forced into different directions, which extend pointing away from each other. Furthermore, the first and the second brackets allow for a low-cost production of the contact device.

In yet another advantageous embodiment according to the first aspect, the at least one deflection element comprises magnetically conductive material or consists of magnetically conductive material. Preferably, the first and the second deflection elements comprise magnetically conductive material or consist of magnetically conductive material. The magnetically conductive material makes it possible to achieve a desired deflection of the magnetic field lines.

In yet another advantageous embodiment according to the first aspect, the second bracket section of the first bracket and/or of the second bracket is designed and situated in such a way that it at least partially overlaps the at least one magnet of the first side or the second side, respectively. Preferably, the second bracket section of the first bracket and/or of the second bracket is designed and situated in such a way that it completely overlaps the at least one magnet of the first side or the second side, respectively. This advantageously allows for a sufficient deflection of the magnetic field lines with little material outlay.

In yet another advantageous embodiment according to the first aspect, the at least one magnet of the first side and the at least one magnet of the second side are situated in such a way that homopolar sides of the magnets face each other. This means, the first and the second magnets are mounted in such a way that they act on each other in a repelling manner. As a result, an additional deflection of the magnetic field lines in the first and the second contact regions can be achieved.

In yet another advantageous embodiment according to the first aspect, the contact device comprises a first magnet which is situated on the first side. Moreover, the contact device comprises a second magnet which is situated on the second side. In this case, the first magnet and the second magnet each overlap a second region which extends from the first contact region of the first connection element to the second contact region of the second connection element.

In yet another advantageous embodiment according to the first aspect, the first magnet and the second magnet are situated and designed in such a way that they overlap at least the first contact region and the second contact region, respectively. This makes it possible to generate a suitable magnetic field. Alternatively, the magnets can also be smaller and can each be situated between the contact regions.

According to a second aspect, the invention is distinguished by an electrical switch which comprises the contact device according to the first aspect, and a drive unit. The drive unit is designed for moving the contact bridge of the contact device back and forth between a first position, in which the contact bridge conductively connects the first connection element and the second connection element, and a second position, in which the first connection element and the second connection element are insulated. Advantageous embodiments of the first aspect also apply in this case for the second aspect.

The electrical switch can be a relay. Preferably, the drive unit comprises a solenoid actuator and the contact bridge assumes the second position when the solenoid actuator is non-energized.

BRIEF DESCRIPTION OF THE DRAWINGS

Exemplary embodiments of the invention are explained in the following with reference to the schematic drawings.

In the drawings.

Elements having the same design or function are provided with the same reference numbers in all the figures.

DETAILED DESCRIPTION OF ILLUSTRATIVE EMBODIMENTS

Figure 1:
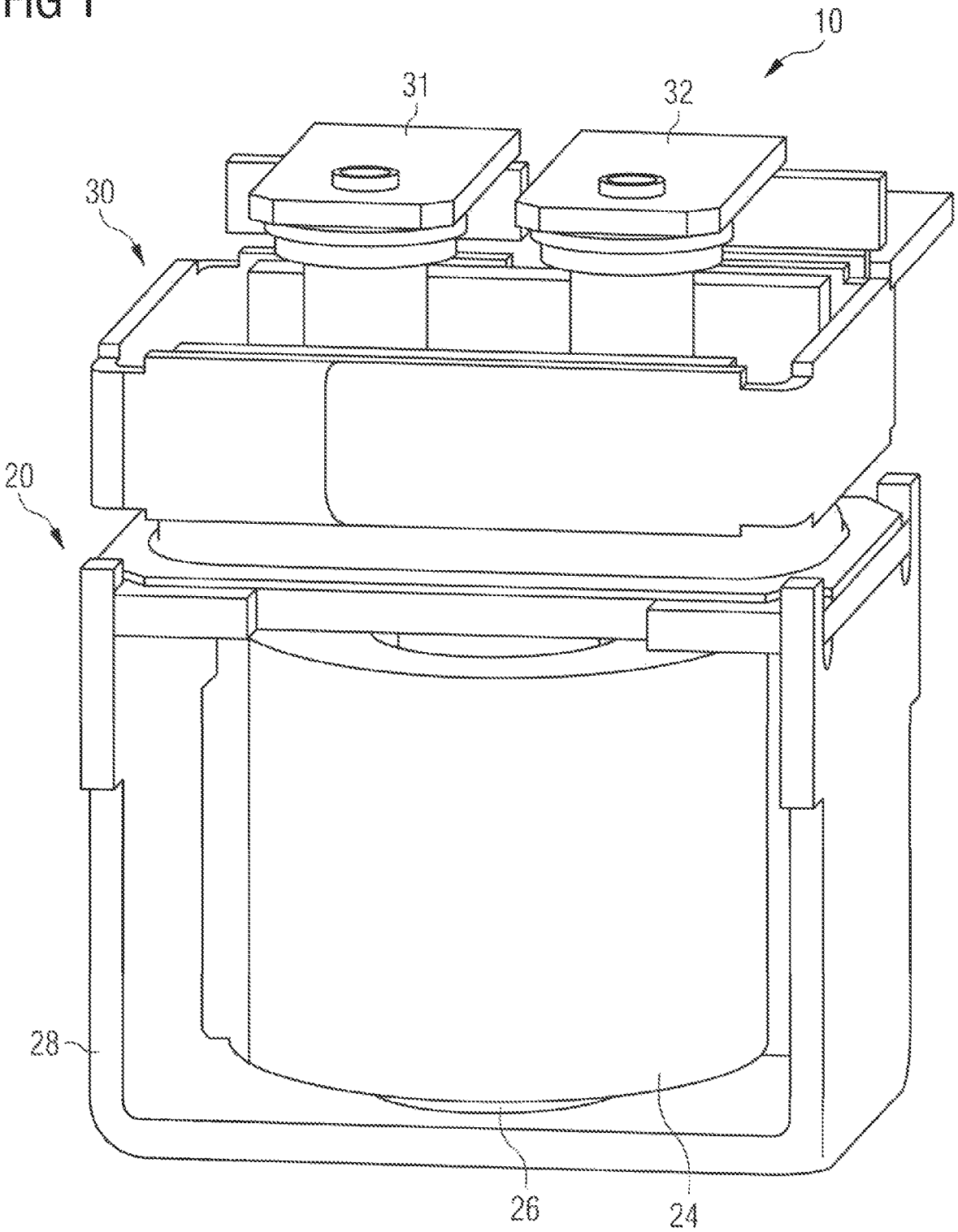
FIG. 1 shows one exemplary embodiment of an electrical switch which comprises a contact device.

FIG. 1 shows one exemplary embodiment of an electrical switch. The electrical switch is designed as a relay 10, for example.

The relay 10 comprises a drive unit 20 and a contact device 30. The drive unit 20 comprises, for example, a solenoid actuator including at least one coil 24 and a plunger 26 which is situated in the at least one coil 24. The coil 24 can be acted upon from the outside with a voltage, in order to generate a magnetic field in the plunger 26, whereby the plunger 26 is movable along its longitudinal axis in the direction of the contact device 30. The coil 24 and the plunger 26 are preferably situated within a magnetizable yoke 28.

The contact device 30 comprises a first connection element 31, a second connection element 32, and a movable contact bridge 33.

Figure 3:
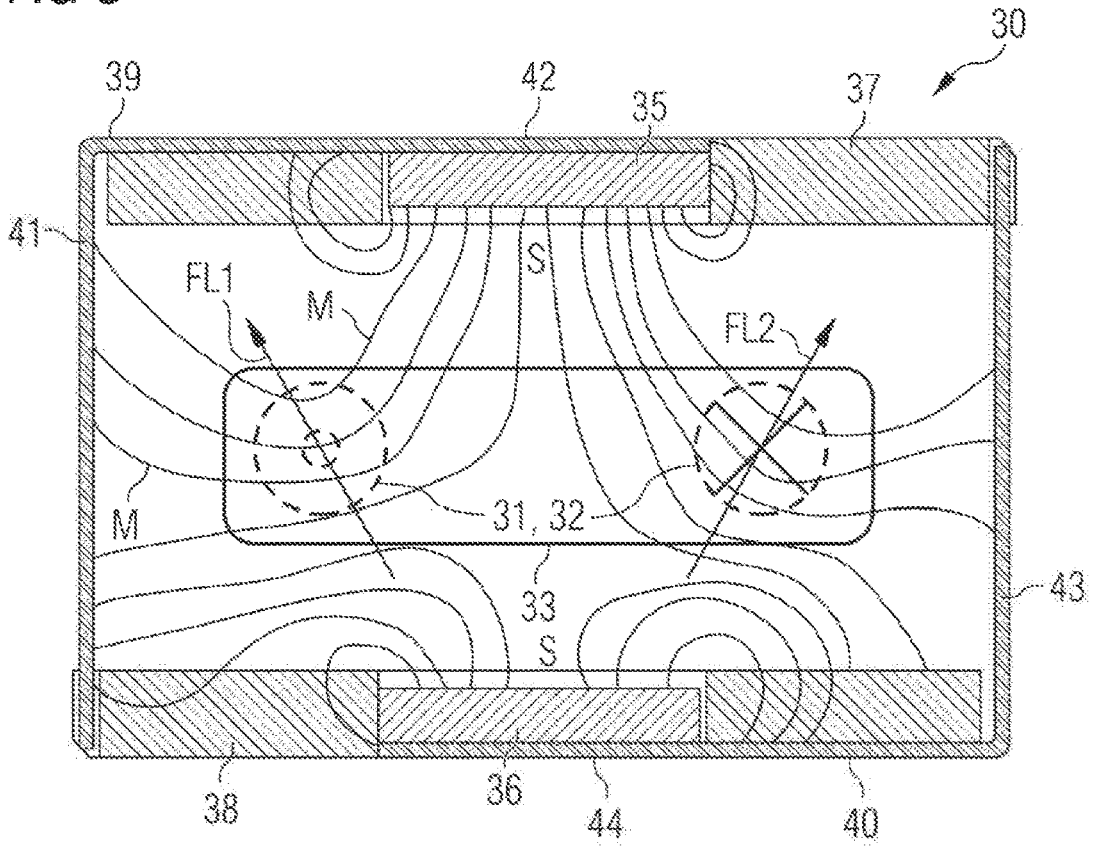
FIG. 3 shows a top view of the contact device having a first magnetic field profile.
Figure 4:
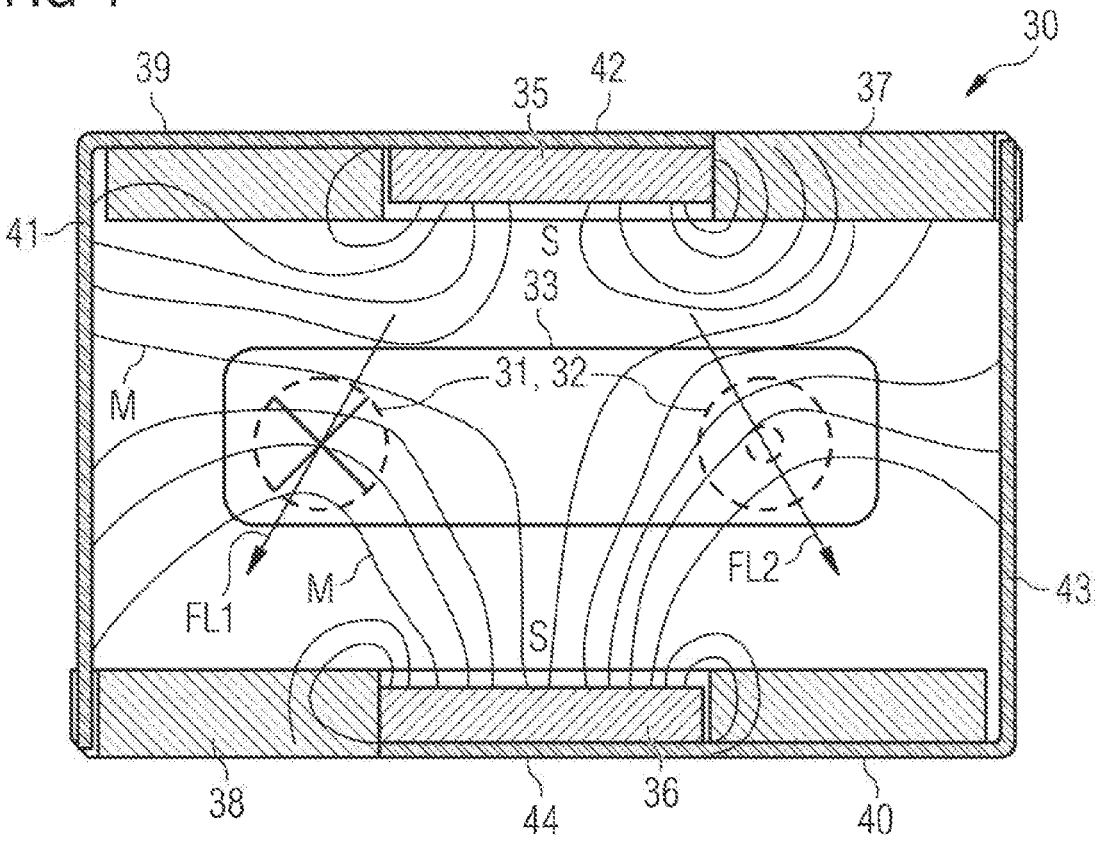
FIG. 4 shows the top view of the contact device having a second magnetic field profile.

The drive unit 20, in particular the plunger 26, is situated and designed for switching the contact bridge 33 of the contact device 30, shown in FIGS. 3 and 4 (but not shown in FIG. 1), between a first position, in which the contact bridge 33 conductively connects the first connection element 31 and the second connection element 32, and a second position, in which the first connection element 31 and the second connection element 32 are insulated, depending on an energization of the coil 24.

The contact device 30 comprises at least two magnets, for example, a first magnet 35 and a second magnet 36, shown in FIGS. 3 and 4 (but not shown in FIG. 1), for quenching arcs which arise during the switching of the electrical switch, wherein the magnets 35, 36 generate a magnetic field in a first region which includes at least a first contact region and a second contact region, in which contact regions, with the electrical switch in a closed switching position, the first connection element 31 and the second connection element 32 are in contact with the contact bridge 33.

Furthermore, the contact device 30 comprises at least one deflection element which is situated and designed for distorting the magnetic field in such a way that a first are, which forms between the first connection element 31 and the contact bridge 33, and a second are, which forms between the second connection element 32 and the contact bridge 33, are forced into different directions, which extend pointing away from each other, independently of a particular current direction in the connection elements 31, 32.

Figure 2:
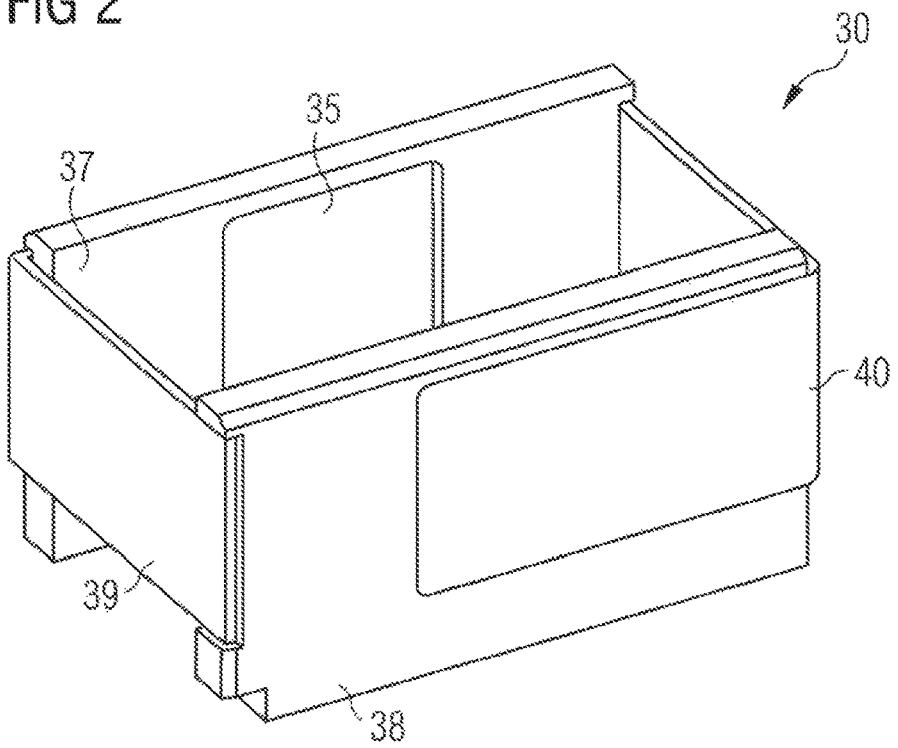
FIG. 2 shows a perspective view of one exemplary contact device.

FIG. 2 shows a perspective view of a first exemplary embodiment of a part the contact device 30. FIGS. 3 and 4 each show a top view of the contact device 30 as further explained below.

The contact device 30 comprises, for example, a frame which delimits a space in which the first connection element 31 and the second connection element 32 as well as the contact bridge 33 are at least partially situated. The frame can be part of a housing or a contact cavity, for example, a ceramic cavity. The frame facilitates a stable arrangement of the magnets 35, 36 and of the deflection elements and, therefore, is optional for the contact device 30. A particular arrangement of the magnets 35, 36 and of the deflection elements with respect to the connection elements 31, 32 and the contact bridge 33 is crucial for the function of the are quenching.

The frame comprises, for example, the at least one deflection element of the contact device 30. For example, the contact device 30 comprises a first deflection element and a second deflection element, which are part of the frame. The first and the second deflection elements preferably comprise a magnetically conductive material or consist of a magnetically conductive material.

The frame comprises, for example, a first side wall 37 and a second side wall 38 which is opposite the first side wall 37. The first and the second side walls 37, 38 are preferably designed to be magnetically non-conductive.

The first magnet 35 is situated, for example, on the first side wall 37. Alternatively, the first side wall 37 comprises a recess in which the first magnet 35 is situated.

The second magnet 36 is situated, for example, on the second side wall 38. Alternatively, the second side wall 38 comprises a recess in which the second magnet 36 is situated.

The first magnet 35 and the second magnet 36 are situated on the first side wall 37 and on the second side wall 38, respectively, in such a way that homopolar sides of the magnets 35, 36 face each other. Preferably, the first magnet 35 and the second magnet 36 are situated directly opposite each other on an inner side of the frame.

The first deflection element has, for example, a first bracket 39 having a first and a second bracket section 41, 42. The first bracket section 41 extends along a first end face of the frame and the second bracket section 42 is situated at least partially along the first side wall 37.

The second deflection element has, for example, a second bracket 40 having a first bracket section 43 and a second bracket section 44, wherein the first bracket section 43 extends along a second end face of the frame, which is opposite the first end face, and the second bracket section 44 is situated partially along the second side wall 38.

The second bracket sections 42, 44 of the first bracket 39 and of the second bracket 40 are situated, for example, on an outer side of the first side wall 37 and of the second side wall 38, respectively.

FIG. 3 shows a top view of the contact device 30. A first magnetic field profile is shown. A current through the first connection element 31 and the second connection element 32 has a first current direction. Furthermore, a first and a second directional vector FL1, FL2 are shown. The first directional vector FL1 represents, by way of example, the direction into which the first are is forced. The second directional vector FL2 represents, by way of example, the direction into which the second are is forced. The two directional vectors FL1, FL2 point away from each other. The directional vectors FL1, FL2 each represent force vectors of the Lorentz force which acts on the ionized air, i.e., the arcs, at the corresponding point.

In particular, the first directional vector FL1 comprises a direction component along a connection axis which connects a center of the first contact region to a center of the second contact region, which points away from the second contact region. The second directional vector FL2 comprises a directional component along the connection axis, which points away from the first contact region.

FIG. 4 shows a top view of the contact device 30. A second magnetic field profile is shown. A current through the first connection element 31 and the second connection element 32 has a second current direction which is opposite the first current direction. The first are and the second arcs are forced into directions other than those in the case shown in FIG. 3. In this case as well, however, the first directional vector FL1 comprises a directional component along the connection axis, which points away from the second contact region, and also the second directional component FL2 comprises a directional component along the connection axis, which points away from the first contact region.

The invention claimed is:

1. A contact device for an electrical switch, the device comprising:

a first connection element;

a second connection element;

a movable contact bridge;

at least two magnets configured to quench arcs which arise during a switching of the electrical switch, wherein the magnets are configured to generate a magnetic field in a first region which comprises at least one first contact region, in which, when the electrical switch is in a closed switching position, the first connection element is in contact with the contact bridge, and at least one second contact region, in which, when the electrical switch is in the closed switching position, the second connection element is in contact with the contact bridge; and at least one deflection element configured to distort the magnetic field such that a first are when formed between the first connection element and the contact bridge, and a second are, when formed between the second connection element and the contact bridge, are forced into different directions, pointing away from each other, independently of a current direction in the connection elements, wherein the at least one deflection element is situated partially around the first region in which the first connection element and the second connection element and the contact bridge are situated, wherein at least one of the magnets is situated on a first side of the first region in which the first connection element, the second connection element and the contact bridge are situated, wherein at least one of the magnets is situated on a second side of the first region, which is opposite the first side, wherein the at least one deflection element comprises:

a first deflection element including a first bracket having a first bracket section and a second bracket section, wherein the first bracket section extends at least partially along a first end face of the first region and the second bracket section extends at least partially along the first side of the first region; and a second deflection element including a second bracket having a first bracket section and a second bracket section, wherein the first bracket section extends at least partially along a second end face of the first region, wherein the second end face is opposite the first end face, and the second bracket section extends partially along the second side of the first region, and wherein the first and second brackets are arranged diagonally to each other.

2. The contact device according to claim 1, wherein a first directional vector representing a direction into which the first are is forced, encloses an angle with a connection axis, which connects a center of the first contact region to a center of the second contact region, within a range of greater than 90° to less than 270°, wherein a second directional vector representing a direction into which the second are is forced, encloses an angle with the connection axis within a range of less than 90° to greater than −90°, wherein the first directional vector comprises a directional component along the connection axis, which points away from the second contact region, and wherein the second directional vector comprises a directional component along the connection axis, which points away from the first contact region.

3. The contact device according to claim 1, wherein the second bracket section of the first bracket or the second bracket section of the second bracket is designed and situated such that it at least partially overlaps the at least one magnet of the first side or the at least one magnet of the second side.

4. The contact device according to claim 1, wherein the at least one deflection element comprises magnetically conductive material.

5. The contact device according to claim 1, wherein the at least one magnet of the first side and the at least one magnet of the second side are situated such that homopolar sides of the magnets face each other.

6. The contact device according to claim 1, wherein a first magnet is situated on the first side of the first region in which the first connection element and the second connection element and the contact bridge are situated, wherein a second magnet is situated on the second side of the first region, wherein the first magnet and the second magnet each covers a second region which extends from the first contact region of the first connection element to the second contact region of the second connection element.

7. The contact device according to claim 1, wherein the two magnets are situated and designed such that they overlap at least the first contact region and the second contact region.

8. An electrical switch comprising:

the contact device according to claim 1; and a drive unit configured to move the contact bridge of the contact device back and forth between a first position, in which the contact bridge conductively connects the first connection element and the second connection element, and a second position, in which the first connection element and the second connection element are insulated.

9. The electrical switch according to claim 8, wherein the first deflection element comprises an L-shaped form.

10. The electrical switch according to claim 9, wherein the second deflection element comprises an L-shaped form.

11. The contact device according to claim 1, wherein the first deflection element comprises an L-shaped form.

12. The contact device according to claim 11, wherein the second deflection element comprises an L-shaped form.

* * * * *